US005167550A

United States Patent [19]

Nielsen

[11] Patent Number: 5,167,550

[45] Date of Patent: Dec. 1, 1992

[54] CONVERSION OF A WATERCRAFT TO A WATER SKIER CONTROLLED DRONE

[76] Inventor: Robert A. Nielsen, 1100 N. Lake Havasu Ave., Unit C, Lake Havasu City, Ariz. 86403

[21] Appl. No.: 619,342

[22] Filed: Nov. 29, 1990

[51] Int. Cl.[5] ..... B63H 21/21; B63B 21/56; B63B 35/73

[52] U.S. Cl. ..... 440/84; 114/253; 114/270; 440/85; 440/87; 441/69

[58] Field of Search ..... 440/84-87; 114/144 A, 270, 263, 254; 441/69

[56] References Cited

U.S. PATENT DOCUMENTS 3,121,415 2/1964 Anderson et al. ..... 440/59
3,828,717 8/1974 Nichols et al. ..... 440/87 X
3,850,130 11/1974 Heuschober ..... 440/84
3,899,993 8/1975 Powers ..... 440/84
4,810,216 3/1989 Kawamura ..... 440/84 X
4,946,411 8/1990 Novey ..... 440/84
5,041,040 8/1991 Jones et al. ..... 441/69

*Primary Examiner*—Sherman Basinger
*Attorney, Agent, or Firm*—Bruce A. Jagger

[57] ABSTRACT

Method and apparatus for converting a watercraft having on-board engine and guidance controls into a drone remotely controlled through towing apparatus by the skier riding on skis behind it. A control unit is secured to the watercraft. The control unit engages the on-board engine and guidance controls of the watercraft. The engine and guidance controls are operated by the control unit through a remotely located tow handle. The tow handle is physically and electronically connected to the control unit.

10 Claims, 6 Drawing Sheets 40
90
148
132
18
22
50
146
130
144
128
56
58
88
82
60
84
104
106
110
202
108
126
122
124
172
176
170
174
200
143
107
182
192
176
142
112
188
114
118
116
100
190
94
184
186
194
160
82
92
76
74
164
72
86
78
70
64
62
204
166
48
65
68
62
67
69
66
38
34
32

166
166
100
218
184
186
188
190
192
194
214
216
106
107
210
212
220
222

CONVERSION OF A WATERCRAFT TO A WATER SKIER CONTROLLED DRONE

FIELD OF THE INVENTION

This invention relates generally to the propulsion unit for water skiing operations, and more particularly to the conversion of a watercraft having on-board engine and guidance controls into a drone remotely controlled through towing apparatus by the skier riding on skis behind it.

BACKGROUND OF THE INVENTION

Water skier controlled drones are known in the prior art. There has also been a variety of tow handle input control devices.

U.S. Pat. No. 2,972,326 to Simpson apparently discloses a device which includes a control tube operating pneumatic valves to stop and start a motor. This patent emphasizes pneumatic operating means.

U.S. Pat. No. 3,828,717 to Nichols et al apparently discloses a boat propelled by an engine and capable of being steered from a point remote from the vessel..

U.S. Pat. No. 3,899,993, to Powers, apparently shows an unmanned watercraft having a rigid handle means for towing a water skier.

U.S. Pat. No. 4,483,683, to Alley. Sr.. apparently discloses a water skiing handle having means thereon to enable the water skier to signal the operator of the tow boat.

U.S. Pat. No. 4,348,976, to Gilbert, apparently discloses an unmanned, self-powered vessel for towing one or more divers to a desired location.

Other U.S. patents show various watercraft control systems including Kulischenko, U.S. Pat. No. 4,228,760; Toyohara et al, U.S. Pat. No. 4,582,493; Kitai, U.S. Pat. No. 4,618,327; Harada. U.S. Pat. No. 4,693,689; Ferguson, U.S. Pat. No. 4,698,035; Fisher, U.S. Pat. No. 4,718,869; and Cooke, U.S. Pat. No. 3,079,885.

Hills, U.S. Pat. No. 3,103,005, and Franklin. U.S. Pat. No. 4,689,611, apparently disclose warning systems having means in the handle enabling the skier to communicate with the operator of the towing boat.

Hardy, U.S. Pat. No. 3,136,288, apparently discloses a motorized ski sled in which the operator stands on a rear portion of the sled and grips a handle which enables him to control the direction and the operation of the motor.

Many of the prior art devices are geared towards a single use for the watercraft, namely, as a drone for pulling a water skier. These prior art drones are expensive and provide the user with limited capabilities and enjoyment for the expense. Most people who enjoy the sport of water skiing also enjoy other water sports such as boating and jet skiing.

SUMMARY OF THE INVENTION

This invention provides for the conversion of a watercraft of the type having on-board engine and guidance controls, such as a Jet Ski watercraft, into a water skier controlled drone. The expense of enjoying the sports of water skiing, jet skiing and motorboating are reduced by providing a watercraft which can be adapted to be alternatively, but not simultaneously, used as a water skier-controlled drone and as a motorboat or Jet Ski watercraft.

This invention provides for an easy conversion of the watercraft without altering any element of the watercraft to an extent that safety, performance or reliability might be affected.

A fail safe design is provided in all aspects from power failure, back-up power loss, lost communications, severed tow line, inoperative controls (actuators or control switches), skier falling, a dropped tow line, malfunction of electronics or other type circuitry, adequate steering, quick stopping to minimize risk of accidents, while not jeopardizing existing use or safety of the watercraft as a Jet Ski watercraft or motorboat.

In a preferred embodiment, all of the conversion apparatus is contained within a drone control unit with features that fit within the confines of the existing parts and do not interfere with their operation, and also allows for an easy hook-up to the watercraft. The control unit is designed to relate to the shape of the watercraft for consumer appeal and product continuity with the watercraft.

The control unit includes mounting means for mounting the unit onto the watercraft in a fixed relationship with respect to the watercraft. The mounting means allow the control unit to be installed and removed easily, quickly and without impairing safety, appearance, reliability or performance.

The overall bulk and weight of the conversion apparatus is kept to a minimum. In a preferred embodiment of the invention, installation of the control unit and, conversely, removal of the unit can be accomplished with only one hand. By using a conveniently placed handle on top of the control unit, a user can easily insert the unit in place, make the appropriate connections, and lock the unit in place.

A preferred embodiment includes an expansion lock-down device that operatively connects with the standard tie-down hole in the rear deck of the many conventional watercraft. The expansion lock-down device retains the rear portion of the control unit from moving side to side with skier forces and further maintains the unit in a locked in position.

In order to achieve the highest level of safety, reliability and versatility, microcontrolling means are used to monitor and direct input from the tow handle controls.

The safety features include an ongoing communications interlock through the tow line, monitoring backup battery status, engine temperature and RPM monitoring, monitoring other failsafe circuits discussed below, testing the entire programming, including all hardware and software prior to operator startup and during operation, presetting throttle, providing preset acceleration levels based on user's weight, monitoring all inputs and providing for preprogrammed failsafe control when any input is negative or a series of inputs fail to respond as programmed.

In a preferred embodiment, a microcoprocessor monitors all of the control functions in the control system. Control information (stop, start, throttle, direction) from the tow handle is transmitted through the tow line to the microprocessor, which is preferably located in the control unit on the watercraft. The microprocessor uses this data to control the starter, the throttle, the steering and the stop switch.

Another advantage of using a microprocessor is that it is relatively lightweight and small, allowing the overall weight and bulk of the unit to be kept to a minimum.

Actuator means respond to signals from the microcontroller and thereby provide for the steering, throttling, stopping and starting of the watercraft in response to input from the water skier.

Preferably, throttle and steering actuators are each driven by a small, D. C. motor through a worn gear reduction driving a small ball screw and free-turning nut.

In a preferred embodiment, steering of the watercraft is achieved with a steering linkage apparatus which is attached to a motor in communication with the microcontroller and to the standard push-pull cable which is connected to a steering element, for example, a steering nozzle on a jet ski.

Control of the throttle is similarly achieved by use of throttle linkage apparatus which is attached to a second motor in communication with the microcontroller and the throttle controls.

The stop and start functions of the engine are preferably connected to the microcontroller by use of a "Y" connection, allowing the stop/start controls to be operated from on-board or from the tow handle.

The watercraft is provided with a tow cable connection member which is fixed with respect to the watercraft and is adapted for tow line connection. Preferably, the connection member is integrated with, or at least fixed with respect to, the control unit.

To allow the tow line freedom to move from side to side as the skier traverses across the waves, the line attachment point is preferably behind the watercraft or above its side walls. A problem resulting from attaching the line in an area above the side walls is that a rolling force is imparted to the watercraft, thus causing instability of the watercraft. Although the pulling or attachment point is preferably in this region of the watercraft, the connection to the tow line should be as low as possible to avoid rollover effects. The preferred attachment area is just behind the watercraft and at its deck level.

A tow line is used to connect the tow handle to the watercraft. The tow line is preferably lightweight and buoyant with a length which may be altered as manufactured without adversely affecting any features other than stability of the watercraft. For safety, the tow line is preferably easy to see because other boaters and those in close proximity should be able to observe the tow line between the watercraft and the skier.

The tow line is preferably comprised of a prestretched tension-bearing line and a thin, light, electrically conductive element inside the tension-bearing line which is connected to the tow handle input and the microcontroller. The signal conducting element is adapted to put the tow handle input controls in operative communication with the microprocessor.

The signal conducting elements are preferably teflon covered to create a low coefficient of friction to the tension-bearing line. This allows the tension-bearing member to move more freely about the signal conducting elements without tearing or breaking them.

A preferred embodiment provides a water sensing means for sensing if the tow line has been dropped in the water. A water sensor is connected to the tow cable member such that the water sensor will send a signal to the microcontroller to shut the engine down if the tow cable is dropped in the water.

After conversion of the watercraft, engine and guidance controls of the drone are controlled by input from a control panel on the tow handle being held by the water skier.

The tow handle of this invention is user friendly and is designed with features that will not interfere with a skier's ability to perform his water skiing desires.

The tow handle is designed similarly to other tow handles which reduces the intimidation of this new water skiing concept. A water skier puts tremendous pull against the tow line. Going around buoys, a skier is almost parallel to the water. When on trick skis, a skier makes 180 degree to 360 degree turns and the tow handle goes through many gyrations, from being rotated to being handed off from one hand to the other. These skiers' needs must be accommodated.

The tow handle preferably does not require a skier to use any of his gripping fingers to operate controls and does not require any rotating of hands or wrists to facilitate control.

Design of the tow handle and handle controls preferably accommodates three objectives, among others. First, use of the controls will not inhibit the skier's ability to retain hold of the handle or impair his skiing performance. Second, the controls are unaffected by movement of the handle, the skier's grip or his position. Third, use of the controls is intuitive. These objectives are obtained by placement of the controls in the center of the handle where they require only slight thumb pressure to actuate them.

The handle preferably comprises six buttons which send signals to the microcontroller to start the engine, stop the engine, increase throttle, decrease throttle, turn the drone left, and turn the drone to the right. These six buttons are adapted to be manipulated by the thumbs of the water skier while he maintains a grip on the tow handle.

The tow handle is designed to permit easy use, without impairing skiing or impacting performance. To this end, the bulk is minimized. Preferably the design does not differ greatly from industry standards of design. The entire design is user friendly, in line with the sleek look of the entire system and the design is not intimidating.

The drone control unit is adapted to fill the watercraft to such an extent that the watercraft cannot hold a driver. The controls, and particularly the steering linkage, are taken over by the drone control unit.

A watercraft must remain somewhat parallel to the surface of the body of water on which it rides in order to function properly. A Jet Ski watercraft, for example, is designed to consider the driver's weight in achieving this level plane. Therefore, the riderless drone must simulate the driver's weight in order to ride in the level plane. This is achieved by a ski pull connection point located at a point whereby the forward forces created by the engine thrust are balanced by the pulling forces exerted by the water skier.

Skier pulling force is used to apply downward load in the Jet Ski watercraft operator's area to optimize the Jet Ski watercrafts performance. The Jet Ski watercraft is designed to require an operator to plane properly and will nose dive and turn without an operator. This simulated downward load is accomplished by coupling the line to the skier above the jet thrusting point (located along pump drive shaft in the lower hull below the center bulkhead). The connection point is in the uppermost area of the bulkhead.

The entire system is waterproofed. Some of the major problems concerning the design of the control housing centered around sealing to prevent water and other contaminants from entering the actuators or electronics.

Preferably, several fail safe systems are provided to shut the engine down in certain emergency circumstances. A water sensor is connected to the tow cable member such that the water sensor will send a signal to the microcontroller to shut the engine down if the tow cable is dropped in the water. Additionally the engine is shut down if the water skier is not grasping the handle or if a lanyard on the water skier's wrist is not engaging a lanyard switch on the handle. The engine is shut down if any of the electrical connections on the system are disconnected. Further, the engine is shut down if the watercraft does not remain approximately level during operation.

Prior to the conversion of the watercraft, the watercraft is, preferably, first modified to allow for quicker and easier conversion. The modification does not change the operative abilities of the watercraft. The modification includes providing a throttle override device which is more easily connected to the throttle linkage apparatus; a mounting device which is fixed to the watercraft to allow for easy mounting of the control unit; a latch plate (if the watercraft is of the type having a handle pole, i.e., a Jet Ski watercraft) which is fixed to the handle pole to allow for quick and easy fixing of the handle pole to the control unit; and, finally, a replacement nozzle which replaces the standard steering nozzle of the watercraft.

For added visibility and recognition, since the public is not used to a Jet Ski watercraft having a ski line attached with a skier at the other end, a red flag is preferably secured to the Jet Ski watercraft and stands about three feet high. This is also used by boaters to communicate that their skier is down. So what this flag means is already understood by boaters and is, therefore, the best means of informing others to this new water skiing device's presence.

Position sensing may be used so that the tow handle may be used upside-down. When the tow handle is flipped over, the left and right buttons and the throttle up and down buttons would have their functions interchanged so that the handle operates exactly the same from the user's perspective. This position sensing is performed by mercury switches and the orientation is sent to the microcontroller with the other switch data.

The control unit is provided with a handle and storage means for storing the tow cable and tow handle when not in use. Therefore the control unit is portable.

The accompanying drawings are submitted for the purposes of illustration and not limitation. The drawings are somewhat simplified in form for the purposes of more clearly presenting the distinctive elements and features of the present invention.

FIGS. *2a, b, c* and *d* are perspective views of the modification apparatus of this invention.

Figure 1:
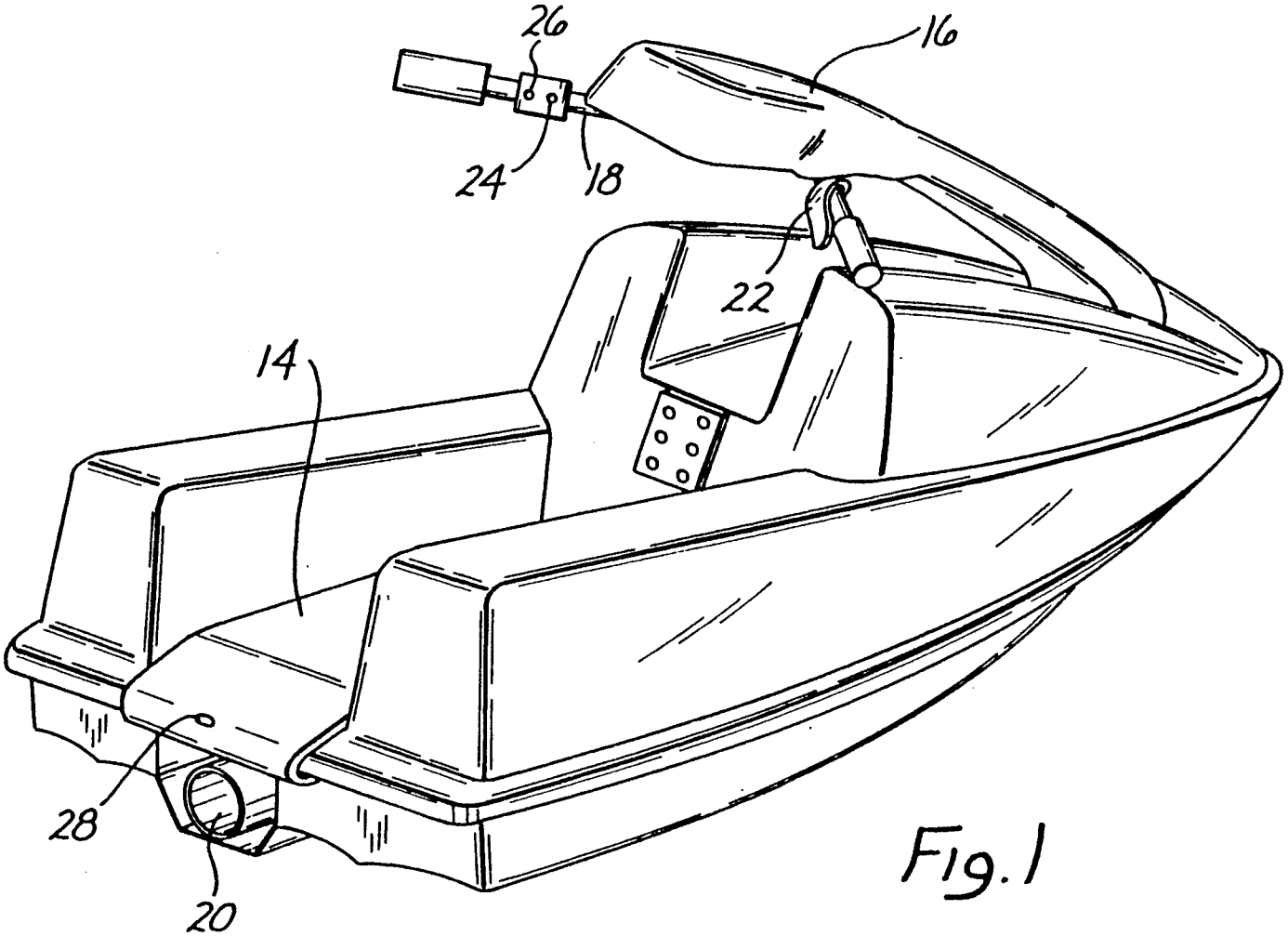
FIG. 1 is a perspective view of a watercraft prior to modification or conversion by this invention.
Figure 2A:
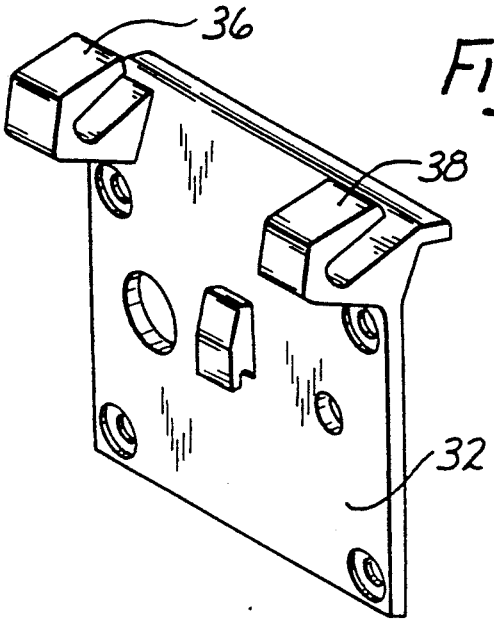
Figure 2B:
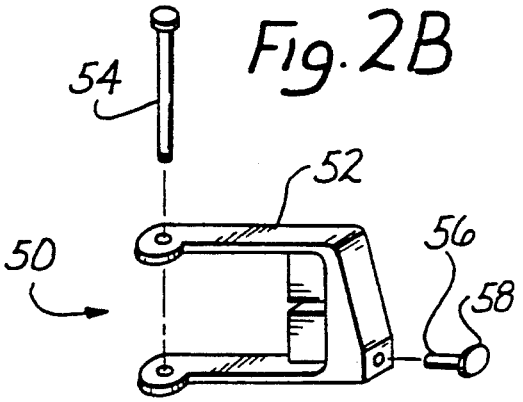
Figure 2C:
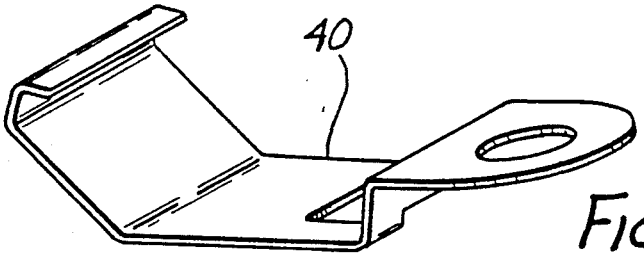
Figure 2D:
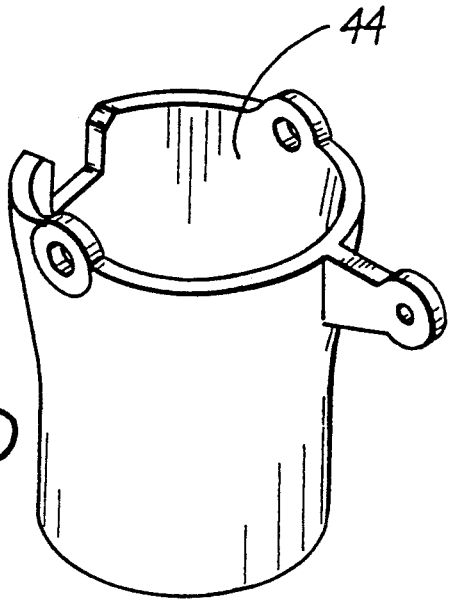
Figure 3:
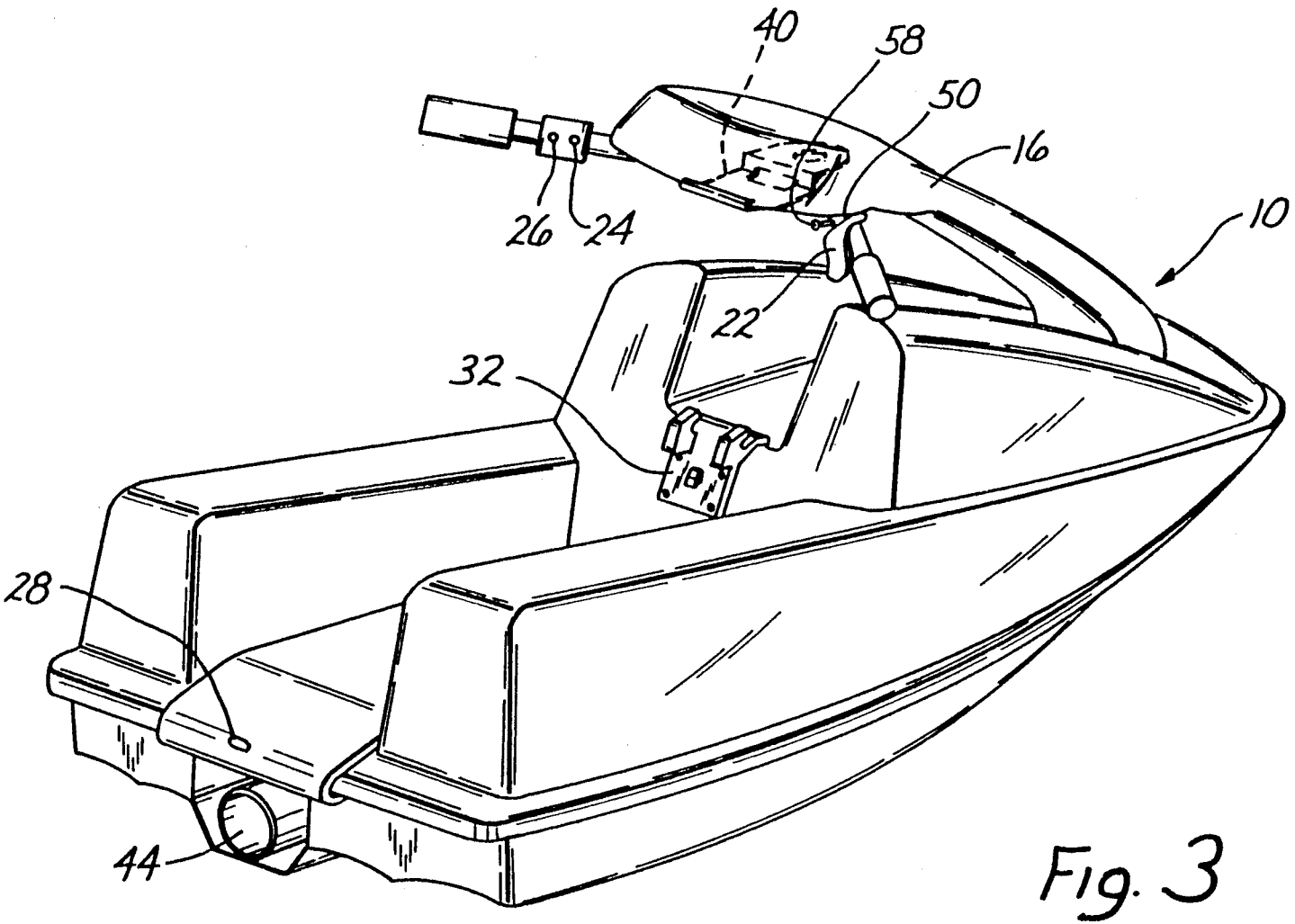

FIG. 3 is a perspective view of the watercraft shown in FIG. 1 after it has been modified with the modification apparatus of FIGS. *2a, b, c* and *d;* with the latch plate of FIG. *2c* shown in dotted lines as it would normally not be seen from this perspective.

Figure 4:
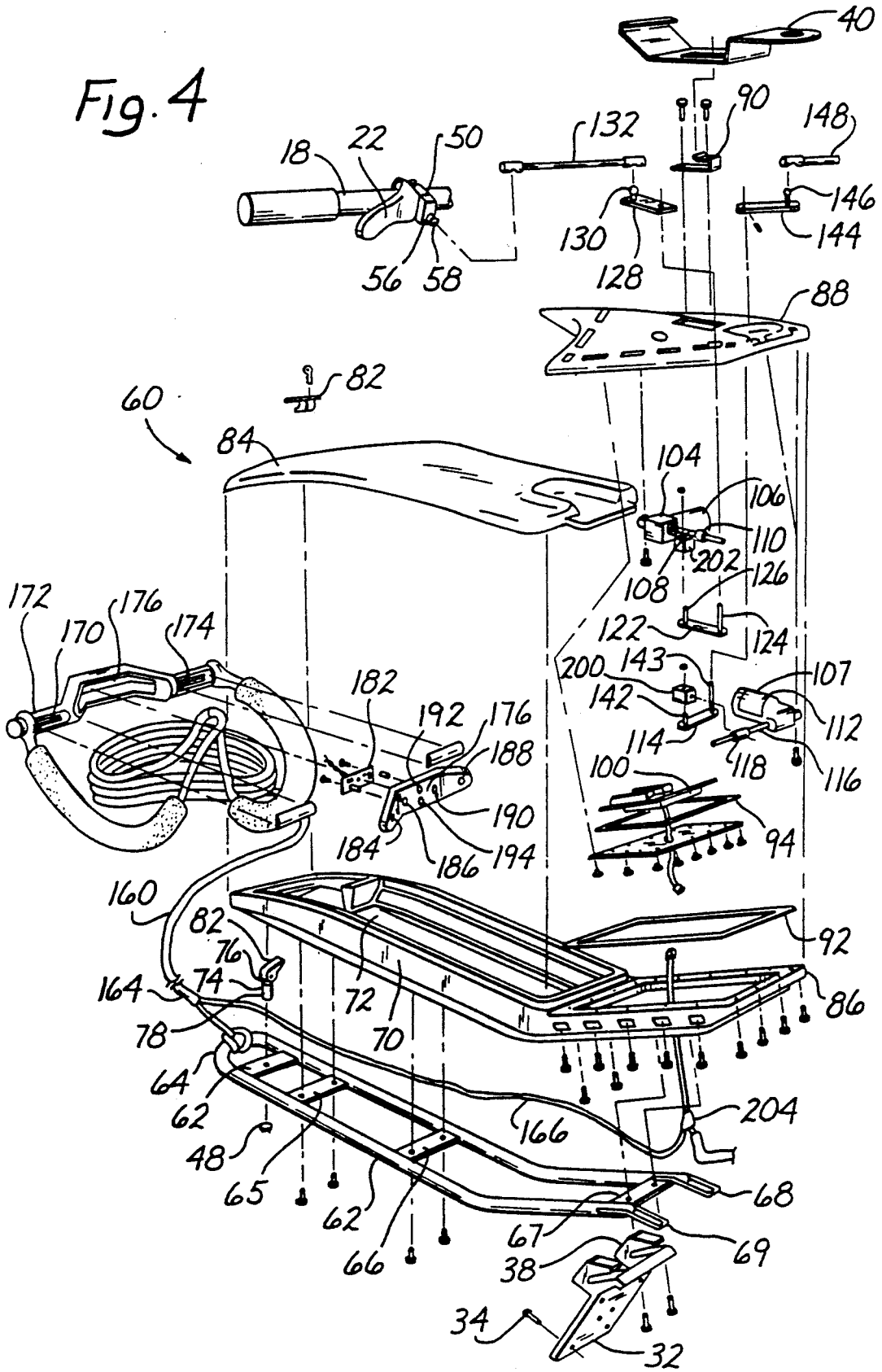

FIG. 4 is an exploded view of the conversion apparatus shown in its portable mode.

Figure 5:
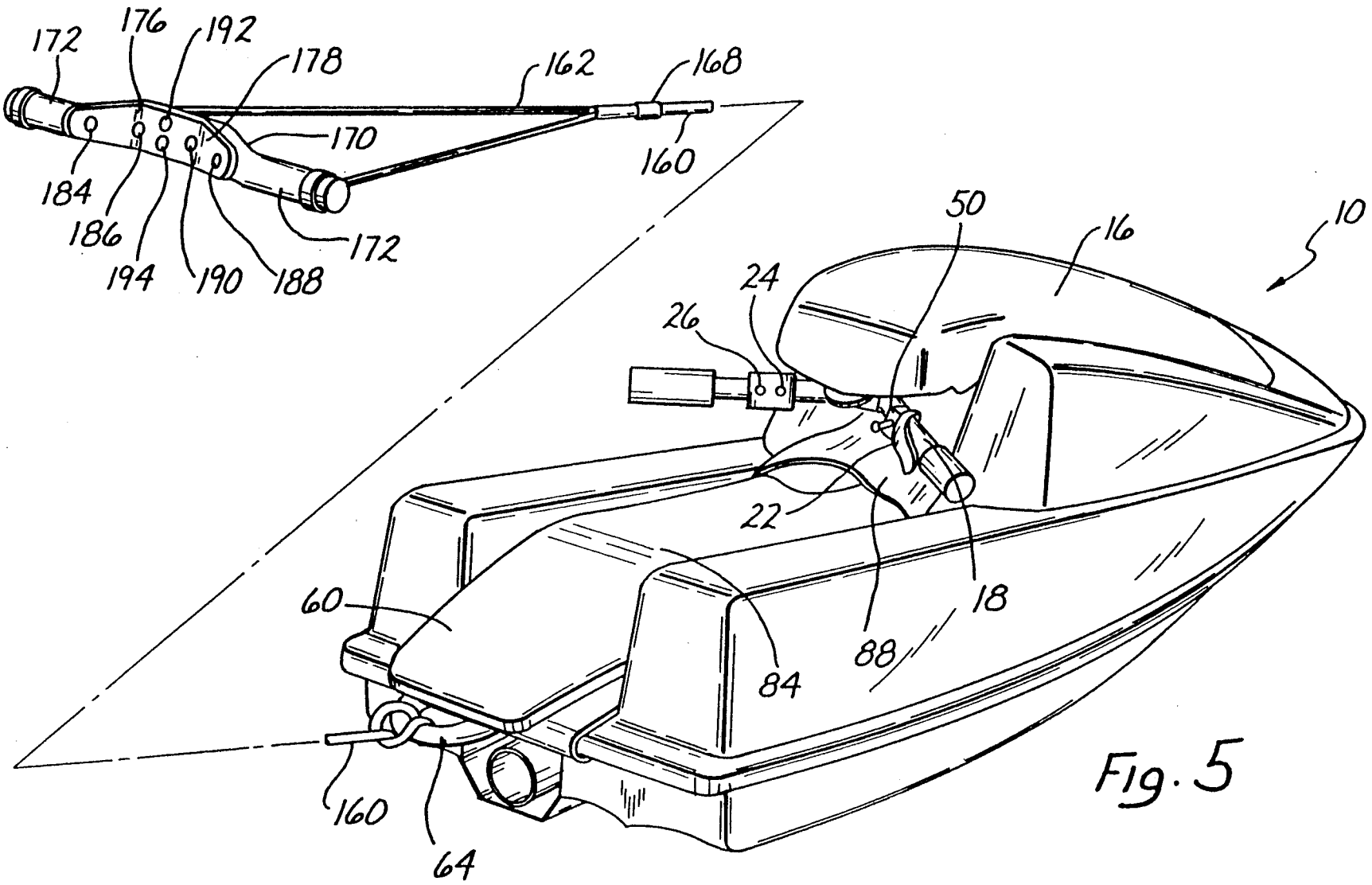

FIG. 5 is a perspective view of a converted water skier controlled drone, including the tow line, water sensor and tow handle.

FIGS. *6a* and *b* are circuit diagrams of the electronics used in this invention.

DETAILED DESCRIPTION OF THE PREFERRED EMBODIMENT

A preferred embodiment of this invention is designed to convert a conventional Jet Ski watercraft into a water skier controlled drone.

FIG. 1 is an illustration of a conventionally available Jet Ski watercraft which is generally denoted therein as numeral 10. As shown in FIG. 1, Jet Ski watercraft 10 provides a ride-on area 14 in which a rider can comfortably position himself to operate the standard on-board Jet Ski watercraft controls. The standard controls are in operative communication with steering nozzle 20 and the engine of Jet Ski watercraft 10. All controls are attached to handle pole 16 which, in turn, is movably attached to the bow of Jet Ski watercraft 10 by way of a hinge which allows the controls to move vertically with respect to the rest of Jet Ski watercraft 10 and remain fixed with respect to, and responsive to, the grasping hands of the rider. The standard controls include handlebars 18, throttle lever 22, start switch 24 and stop switch 26. Steering is accomplished by rotating handlebars 18 with respect to handle pole 16. Steering nozzle 20 responds appropriately.

Modification

As stated, the object of this invention is to convert Jet Ski watercraft 10, shown in FIG. 1, to the water skier controlled drone, shown in FIG. 5. In order to accomplish this conversion easily, and in the shortest period of time, Jet Ski Watercraft 10 is first modified. The portions of Jet Ski watercraft 10 which are involved in this modification are throttle control 22, handle bars 18, steering nozzle 20, and bulkhead plate 30.

The modification involves six steps. First, center bulkhead plate 30 is replaced with replacement bulkhead plate 32 shown in FIG. *2a.* The replacement plate 32 contains two hooks 36, 38 which are used to mount the control unit, as will be explained in more detail below.

Secondly, throttle override device 50, shown in FIG. *2b,* is attached to the existing throttle lever 22. Override device 50 includes override bracket 52, ball stud 58 which is a portion of a linkage hookup 56, and a long throttle pivot pin 54 Installation is permanent. This override device 50 does not interfere with the normal operator use of the throttle lever 22. However, throttle lever 22 can be overridden whenever the control linkage is attached, as will be discussed below.

Thirdly, latch plate 40, shown in FIG. *2c,* is attached to handle bars 18. Latch plate 40 is installed under the front portion of handle pole 16 by removing a steering yoke nut and washer, installing latch plate 40, and replacing the yoke nut over a new washer. Latch plate 40 remains in place and does not inhibit use of Jet Ski watercraft 10.

Fourth, steering nozzle 20 is replaced with new steering nozzle 44, shown in FIG. *2d.* This modification to the steering nozzle allows it to rotate further and provides a greater stroke in the control actuator. This modification does not affect or change the stock Jet Ski watercraft performance or reliability. Nozzle 20 is easily changed, without further Jet Ski watercraft disassembly.

Wires are available in the underside of the handle pole area to secure a power source to operate the electronics and electric actuators along with the logic connections for start and stop functions. Connections are secured using a "Y" wire connector 204, and to protect them from the environment they are covered with RTV. Any other logic needs, such as engine temperature or RPM, are obtained in the same manner. These connections are made without damaging existing wiring or reliability and the start and stop functions of the JET SKI watercraft are paralleled by contact closures controlled by microprocessor 100. The various leads all terminate in a rubber connector that rests up under the handle pole in a secure area, but is easily accessible to connect to the cable from the drone control unit during hook-up. They are very durable, resist water and have a good level of connection reliability FIG. 3 shows Jet Ski watercraft 10 after this modification. The Jet Ski watercraft in FIG. 3 is now ready to be quickly and easily converted into a water skier controlled drone. It is assumed that the conversion from Jet Ski watercraft to drone and back to Jet Ski watercraft will take place several times according to the whims of the Jet Ski watercraft owner. This modification is only done once and entails only minor and operatively insignificant modifications to Jet Ski watercraft 10.

Conversion

An exploded view of control unit 60 in its portable mode is shown in FIG. 4 where all of the conversion apparatus can be seen.

The conversion apparatus is shown mounted on Jet Ski watercraft 10 in FIG. 5.

The first step in the conversion process involves mounting of control unit 60 onto ride-on area 14 of Jet Ski watercraft 10. Control unit 60 is designed to fill ride-on area 14. The on board controls are acquired by control unit 60, and the operator steering means and handle pole 16 are locked, thus converting the Jet Ski watercraft 10 into a drone controlled only by the water ski handle apparatus. While control unit 60 is mounted in operable position the Jet Ski watercraft can not be ridden or operated by the usual controls.

Control unit 60 generally includes mounting means, control means, a control enclosure, line and handle storage bin, and a carrying handle.

In order to cause the Jet Ski watercraft to ride properly, the normal operator load (or weight) must be simulated. A ski pull connection point located above the thrust line does that.

Skier pulling force is used to apply downward load in the Jet Ski watercraft operator's area to optimize the watercraft's performance. The Jet Ski watercraft is designed to require an operator to plane properly and will nose dive and turn without an operator. This simulated downward load is accomplished by coupling the line to the skier above the jet thrusting point (located along pump drive shaft in the lower hull below the center bulkhead). The connection point is in the uppermost area of the bulkhead.

The mounting means is comprised, for example, of tubular frame 62 that connects at one end to the Jet Ski watercraft and to the skier tow line at the other. Frame 62 is conveniently comprised of one inch diameter tubing with a formed 180-degree bend 64 and cross-braces 65, 66, 67 welded in place to accommodate attachment to main housing 70. Bracket 63, fixed close to bend 64, is for mounting rear hole expansion lock-down device 74, whose function is discussed below. There are two welded in place loops 68, 69 located at the open ends. These loops 68, 69 are used to lock frame 62 onto hooks 36, 38 of the center bulkhead replacement plate 32.

A rotational molded housing 70 attaches next to the frame 62 and the double walled design of housing 70 provides an extra level of safety from moisture, physical abuse and vibration, and has a high level of impact strength.

Forward compartment 86 houses the controls and seals to the control cover 88 via a round cross-sectional seal 92 that is compressed against a flat mating surface on the housing using fastening screws around the circumference. Forward compartment 86 houses microprocessor 100 and its associated electronics, and control actuators 104, 112. Cover 88 contains all the actuator mounting means and also provides the mount for the bearings and seals for the two actuator rotating linkages 122, 114. Shafts 124 and 126 project from opposite ends of linkage 122, and shafts 142 and 143 project from opposite ends of linkage 114. Additionally, control cover 88 has a secondary compartment to house the electronics so that when control unit 60 is assembled the electronics enjoy a double seal against moisture and contaminants. Control cover 88 preferably includes a molded end handle, and is generally an injected molded part. Secondary cavity 98 for the electronics also has its own similar sealing means 94. Entry and exit of wiring is via liquid-tight fittings secured through cavity cover 88. Also provided is the mounting means for both control actuators 104, 112 and their rotating output linkages 122, 114, the output linkages 122, 114 being coupled to the respective actuators 104, 112 by means of connecting blocks 202, 200 which are coupled to the respective free-turning nuts 110, 118. Each of the output linkages 122, 114 is provided with a respective output shaft 124, 143 which is pivotally coupled to control cover 88 by means of bearings through which the shafts 124, 143 pass through. On the opposing end of respective output linkages 122, 114 there is provided respective shafts 126, 142 which are pivotally coupled to respective free-turning nuts 110, 118 by means of the connecting blocks 202, 200. Thus, responsive to rotation of the threaded actuator shaft 108, 116 the free-turning nut 110, 118 is linearly displaced, thereby causing the output linkage 122, 114 to rotate about the output shaft 124, 143. The throttle linkage 128 is coupled to the output shaft 124 for rotation therewith, and therefore causes a linear displacement of the flexible linkage 132 responsive to rotation of the output linkage 122, when the nut 110 is linearly displaced by rotation of the threaded shaft 108. Similarly, the push-pull cable 148 is linearly displaced responsive to rotation of the steering actuator linkage 144 which is coupled to the output shaft 143 of output linkage 114, providing a push or pull on cable 148 responsive to linear displacement of the nut 118 responsive to rotation of the threaded shaft 116 of actuator 112. Bearings are preferably of a special plastic requiring no lubrication. Also, seals are generally elastomeric.

Rear storage compartment 72 is a storage area for tow line 160 and ski handle 170. Since the ski line 160 does not incorporate any disconnect 170 means, an area providing enclosed storage is essential for safeguarding and protecting the ski handle 170 and tow line 160. This feature may also have a secondary benefit of offering a level of security from theft by incorporating a lockable latching system 82.

A second use for the rear storage compartment 72 is to house the expansion lockdown device 74 that operatively connects with the standard tie-down hole 28 in the rear deck of the Jet Ski watercraft. Expansion lock-down device 74 is comprised of an axially moving rod 76 whose movement will compress rubber plunger 76, installed in rear hole 28, to retain the rear portion of control unit 60 for moving side to side with skier forces and further maintain frame 62 in a locked-in position. Axial movement of the rod 76 is accomplished via a cam 82, as part of the lower area of a locking lever. To actuate the lock, a simple 120 degree movement of the cam lever expands the rubber plug 78, thereby locking the rear portion of the unit 60 in place.

Storage compartment 72 is conveniently secured using a plastic vacuum-formed cover 84. Cover 84 locks under control cover 88 and is finally latched by mechanical locking means.

Handle pole 16 must be held down to avoid bouncing and changing the disconnection of the linkages which will be discussed below. Also, handlebars 18 must be kept from rotating as the throttle linkage 128 connects directly to the throttle override device 50 and any movement of the handlebar 18 would add or subtract from the desired throttle position. To accomplish this, latch 90, installed atop control cover 88, engages latch plate 40 doing the two required functions, namely, holding handle pole 16 in its down position, and securing handlebars 18 from rotation.

Normal steering via handle pole 16 is disabled. The cable end of the nozzle push-pull cable 148 is disconnected from the handle yoke ball stud and attached to steering ball stud 146 which is fastened directly to steering actuator linkage 144. Upon removal of control unit 60, the steering cable must be reconnected using the quick disconnect already in place at the end of the steering cable.

Additionally, steering is enhanced (as skier pulling forces couple out a portion of the steering thrust) by increasing the push-pull cable throw or travel and by incorporating the described modification to the standard nozzle, thus allowing an increase in angular travel.

The throttle linkage hookup is similar to the steering linkage hookup. The position of finger throttle 22 on handlebar 18 varies both axially and radially on different watercraft (throttle 22 is just clamped to handlebar 18 and may be adjusted to suit the owner). Therefor a flexible linkage 132 constructed from a semi-ridge wire rope (with threaded ends) is used. Quick disconnects at each end are connected over ball studs 58, 130.

Installing control unit 60 and, conversely, removing it can be accomplished with only one hand as the handle is incorporated approximately at the balance point in the control cover. With the handle pole lifted slightly, one can insert the unit in place, connect cable, steering and throttle linkage, lower the handle pole and slide the control unit rearward until stopped, lift the storage cover, move the expandable plug lever to the release configuration to ensure insertion in deck hole 28 and rotate it 120 degrees, close the cover and latch it. It is ready to operate.

As shown in FIG. 4, throttle actuator 104 and steering actuator 112 are each driven by a small D. C. motor through a worm gear reduction driving a small ball screw 108, 116 and free-turning nut 110, 118. (Nuts are free-wheeling at end of stroke). The D. C. motor which drives throttle actuator 104 is indicated at 106 and the D. C. motor which drives the steering actuator 112 is indicated at 107.

Tow line 160 is lightweight and buoyant with a length which may be altered as manufactured without adversely affecting any features other than stability of the Jet Ski watercraft and is easy to see (for safety, other boaters and those in close proximity must be able to observe the tow line between the pulling device and the skier).

Tow line 160 is comprised, for example, of ⅜" diameter polyethylene hollow single braided line 164. This tension-bearing line 164 is prestretched and thin lightweight signal conducting elements 166 (teflon covered for low coefficient of friction to tension-bearing line 160) are fed down the center.

Water sensor 168 accepts the tow line 160 through its center and is secured using a synthetic thread sewn through a hole and around tow line 160. Sensor wires are fed through tow line yoke 162 and into ski handle 170. Location of water sensor 168 is just above ski handle line yoke 162. Communication wires 166 may be spliced, used with connectors or roughed into both the handle 170 and control cover area 88 and finally soldered in place, thus avoiding any possibility of failure due to physical abuse or electrolysis.

A perspective view of ski handle 170 is shown in FIG. 5. Handle 170 is comprised on aluminum or plastic casting, and is preferably cored from the user side to provide access for control wires entering through one or both ends along with the switch and its support circuitry.

Handle 170 is covered with molded in place soft rubber for user comfort and enhanced gripping in the gripping area and outward. The outward rubber detail provides a means for securing tow line 160 to the casting. Plastic inserts fill the gripped core area and provide access for servicing.

Center area 176 is cored and houses control switch assembly 182 and its associated electronics. This cavity 176 is potted when assembly is complete to inhibit water entry and protect the components.

Control switch assembly 182 is designed using injection molded polypropylene to allow for a living hinge concept as switch actuators to provide a water-tight design. In operation, this switch array is covered using a self-adhering silk-screened label 178 providing user information along with abuse protection from user and environmental adversities. Each switch button 184-194 is simply a diaphragm that when depressed, deflects a flat metal contact strip that doubles as a return spring and makes an electrical connection between two pressed in pins. The pins are assembled into a plug that is in turn sonic, welded and sealed into the backside of the switch housing. The pins extending outward beyond the plug serve as wire connections. The entire assembly with its supporting printed circuit mounted (backside) has additionally two lineal living hinges that when flexed, allow entire assembly to be assembled into the casting via four screws.

Switch buttons 184–194 are manipulated by the water skiers thumbs since they are in the center area when gripping hands in the conventional manner, and they are not used for gripping of the ski handle 170. Therefore, the left thumb operates left turn button 184 and throttle down button 186. Right thumb operates right turn button 188 and throttle up button 190. Start button 192 and stop button 194 are located on vertical center which gives skier choice of thumbs for those functions.

Handle 170 preferably includes a lanyard-type kill switch, which incorporates a small reed switch epoxyed just above and in the core center area. Also epoxyed in the rear of the insertion hole is a metal slug. A lanyard including a wristband with a coiled line securing a key-like device that contains a magnet in its leading end. In operation, the key is inserted into the switch hole and held in place via the magnetic attraction to the in place metal slug. However, while in place, the magnetic force causes reed switch to close, thus providing a signal to microprocessor 100 that the operator safety interlock device is in place.

Microcontroller 100 monitors all of the control functions in the Jet Ski watercraft control system. Control information (stop, start, throttle, direction) from handle 170 is transmitted over a two-wire serial link provided by the conductive wires 166 to microcontroller 100, which is located in control unit 60 on Jet Ski watercraft 10. Microcontroller 100 uses this data to control the starter, the throttle, the steering and the stop switch.

Figures 6A, 6B:
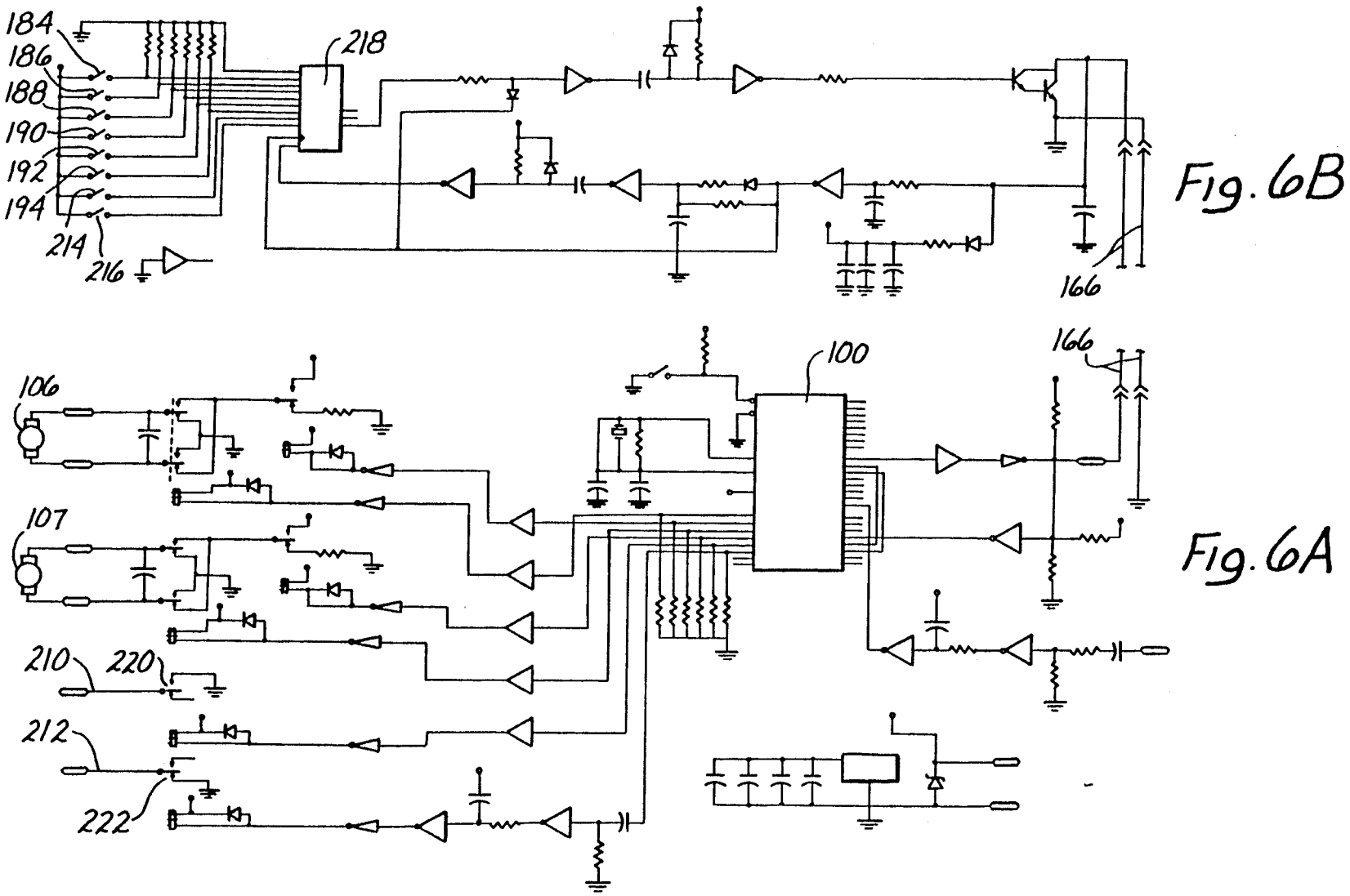

Handle 170 contains electronic hardware, shown in FIG. 6B powered by the serial link, which translates the switch settings into a serial data stream. Switch inputs 184–194 represent the pushbutton control inputs of handle 170, switch input 214 represents the lanyard-type kill switch input, and switch input 216 represents the switch input of the water sensor 168.

Microcontroller 100 generates a clock signal necessary to read in the serial switch data and sends it to handle 170 over the serial line. Hardware on handle 170 translates this signal into a clock and a load signal for converting the switch data to a serial stream. Additional hardware uses the serial signal to generate DC power for the other handle electronics. The data from buttons 184–194 is converted to a serial stream and is time-multiplexed by multiplexer 218 onto the serial line with the clock signal. The serial data is then processed by microcontroller 100, which sends signals to control the operation of Jet Ski watercraft 10.

Jet Ski watercraft throttle and direction are controlled by actuators 104, 112. The positions of actuators 104,112 are determined by motors which are controlled by microcontroller 100.

Program switches allow the operator to configure the system according to his or her skill level and size. Different speeds for starting-up can be set with these program switches along with other options.

Microcontroller 100 sends out an oscillating signal to indicate that the engine can be running. This signal is monitored by external hardware to determine if microcontroller 100 is operating properly and shuts off the engine if it is absent.

Referring to FIG. 6A, there is shown the microprocessor 100 and its peripheral circuitry. As shown, the microprocessor 100 receives input signals from the control handle electronics through the serial data link provided on the conductive wires 166. Responsive to software control, microprocessor 100 outputs command signals for driving respective actuator motors 106, 107 as well as providing respective start and stop command signals 210, 212. The start and stop command signals 210, 212 are provided by respective relay contact closure 220, 222 which provide the means by which the JET SKI watercraft start and stop switch contacts are paralleled.

Microcontroller 100 is controlled by software located in the Read-Only-Memory (ROM). This software contains routines to monitor the switches and to control the operation of the Jet Ski watercraft. A description of each of the routines follows.

The kill routine is executed when lanyard switch connection is broken or whenever the water sensor 168 s actuated. Upon detecting this condition, the engine is shut off, the throttle is reduced to zero and the direction controls are centered The kill routine takes priority over all other actions; no operations may take place unless the kill switch is activated.

The kill signal ensures the engine is killed in the event of any type of failure. If this signal is not present for any reason (i.e., skier lets go of handle, control wire breaks) the microcontroller initiates the kill routine. Two separate complementary kill signals provided by switches 214, 216 are used; the absence of either signal would initiate the kill routine.

The start-up routine is used to pull the skier out of the water. It is initiated by simultaneously pressing the start and throttle-up buttons. When initiated, the start-up routine increases the throttle to full power for a fixed amount of time and then eases back on the throttle a certain amount to prevent the skier from accelerating too much. Once the skier is standing, the drag on the Jet Ski watercraft reduces considerably. The throttle-up and throttle-down times are dependent upon the size and skill level of the skier; therefore, different times may be selected by setting the switches on the Jet Ski watercraft. The skier may abort this routine and return to normal operation at any time by pressing either one of the throttle buttons. Steering is permitted to operate normally during start-up.

The microcontroller software is responsible for control of the start-up routine. It first checks to see if the motor is running, and bypasses the routine if it is not. If the throttle is not at a minimum or was not recently at a minimum, the routine is also by-passed. Next, if the start and throttle-up buttons are pressed and the start-up routine has not been started, it is initiated. If the start-up routine has previously been initiated, it is determined whether it is time to throttle up or down, and the corresponding action is performed. Small delays (~100 ms) are inserted before throttling up or down in order to allow the motor to slow before abruptly changing directions. As long as the start and throttle-up buttons are held down, the start-up routine continues. When one of the buttons is released, a small amount of time (~500 ms) is allowed for the other button to be released. Any press of a throttle button after this time results in the termination of the start-up routine.

There are two possible control input schemes to manipulate the direction and the speed of the Jet Ski watercraft. The first mode gives the operator continuous control. Pressing a button will cause the corresponding actuator to move as long as the button is held down, until it reaches the end of its range of motion. The second mode gives the operator pulsed control. Pressing a button will cause the actuator to move a specified amount, to pause and, if the button is still pressed, to move continuously until the button is released. The pulse mode was implemented so that the operator could give the actuator very short pulses. This mode would be desirable if the length of time for a typical button press is so long that fine actuator control is not possible otherwise.

When either throttle or direction buttons are pressed, the microcontroller first determines if both throttle or both direction buttons are being held down. If so, the second throttle or direction button pressed is ignored. The microcontroller then determines if the button press is new or if it is the same button being held down. If the press is new, the microcontroller then checks to see if the actuator is to travel in the same direction as it was previously. If the direction is different, it makes sure that a short delay (~100 ms) has elapsed to allow the motors to slow down before changing directions. The microcontroller then calculates a minimum pulse duration (~250 ms) and, if in the pulsed mode, the pulse off and on times. When a button is being held down, the microcontroller monitors how long it has been pressed to make sure that the minimum pulse duration requirement is met.

The drone control system is semi-closed loop. The microcontroller receives position data from the actuators. However, reed switches will signify the end of travel position for each of the actuators, signifying the control is full left/right/up or down. A closed loop system with optical encoders providing feedback can verify the actuator position by enabling the microcontroller to count the number of revolutions the motor has turned. Another source of feedback for the throttle controls is the engine spark. The microcontroller can serve as a tachometer by measuring the frequency of the spark. It can then control the speed of the Jet Ski watercraft by monitoring the engine speed and adjusting the throttle.

There are four safety interlocks, "fail safes" that, are not shown in the accompanying figures but, may be included in this system. First, use of a lanyard attached to skier's wrist (personal watercraft and boating industry standard attachment area) at one end and a key that must be completely inserted into a receptacle in the lower center area of the ski handle. Any movement of this "fail safe" key will cause controls to kill personal watercraft engine. This key must be removed and inserted before the engine may be restarted to prevent operator misuse.

Another means for detecting that a skier has fallen or let go is a handle switch. This device is comprised of a lever along the handle gripping surface that is spring loaded open and gripped closed and would not inhibit the skier's performance other than releasing of that hand (for any reason). This kind of safety is used on the 45 Caliber ACP Auto Colt Pistol as a safety interlock.

A water sensor 168, shown in FIG. 5, attached approximately three (3) feet ahead of skier to the tow line, that when struck by water (as in falling or dropping ski handle) will cause control to kill personal watercraft engine.

Another "fail safe" is by means of an ongoing communication through one wire from the control unit into the handle and back up a second wire to be received and decoded many times a second. Any break in this ongoing communication will cause control to kill personal watercraft engine.

A power failure or loss of any signal from the personal watercraft device will cause control to kill engine along with retracting throttle.

Another fail safe would be to disengage the actuator from the throttle linkage on a power failure and allow the spring to return the throttle to idle. (This is what happens when the Jet Ski watercraft operator releases the Jet Ski watercraft throttle lever).

A circuit is used to detect when the motor is running. When the motor is running, the starter will be disabled by the microcontroller. When the motor is not running, the starter will operate normally.

Within the microcontroller, there is a watchdog timer working independently from the CPU which can reset the microcontroller if the microcontroller is not working properly. The timer requires an active reset pulse from the CPU several times a second. This reset pulse is only generated if the microcontroller code is being properly executed.

Position sensing may be used so that handle 170 may be used upside-down. When handle 170 is flipped over, the left and right buttons and the throttle up and down buttons would have their functions interchanged so that the handle operates exactly the same from the user's perspective. This position sensing is performed by mercury switches and the orientation is sent to microcontroller 100 with the other switch data.

Some of the major problems concerning the design of the control housing are centered around sealing to prevent water and other contaminants from entering the actuators or electronics. Moisture is detrimental to electronics, so they are preferably enclosed in a plastic cavity sealed using an endless round cross-section seal with a cover plate that passes all conductors through liquid tight fittings. The cover plate may also serve as a mounting means for circuitry and heat sinking.

The actuators are preferably housed in plastic and sealed in a similar manner. The electronics cavity is preferably contained in the actuator housing creating, therefore, a double seal.

Preferably, rotary linkage is used because sealing a rotating shaft has the greatest upside potential. The rotating shafts are guided using a special plastic bear material not needing lubrication. (Lubrication would most likely be washed away if used anyway). A combination seal is preferably used having an inner seal for resisting moisture and dirt [will be made of special plastic for the same reason) with a constant force lip for best sealing and an outer seal serving to steer moisture and dirt away from seal lip face. And above it, a flanged plastic bearing to couple out axial and radial thrust and be first in line to ward off contaminants.

The actuators are housed in plastic and sealed in a similar manner. Electronic cavity is contained in actuator housing and this is, therefore, double sealed.

While particular embodiments of the present invention have been shown and described, it will be obvious to those skilled in the art that changes and modifications may be made without departing from the invention in its broader aspects and, therefore, the aims of its appended claims are to cover all such changes and modifications as fall within the true spirit and scope of this invention.

What is claimed is:

1. A drone control system including a drone control unit, a light, flexible tow cable member and a tow handle element for readily reversibly converting a small normally operator ridden conventional watercraft of the type having on-board engine and guidance controls into a water skier controlled drone watercraft comprising:

said drone control unit adapted to being removably mounted to said watercraft to permit control of the operation of said watercraft from a remote location, said drone control unit including a microcontroller device for monitoring and directing control information, actuator members in operative communication with said microcontroller device and adapted to being operatively connected to said on-board engine and guidance controls on said watercraft to activate such controls responsive to directions from said microcontroller device;

a releasable mounting mechanism adapted to quickly and easily install and remove said drone control unit from said watercraft;

said flexible tow cable member including a tension bearing member adapted to provide a towing connection between said watercraft and a water skier, and a light weight electrically conductive member carried by said tension bearing member and adapted to being connected in operative communication with said microcontroller device; and said tow handle element adapted to being operatively connected to said tow cable member and grasped by an operator of said drone control system for towing and control purposes, said tow handle member including input control members for supplying control information to said microprocessor device through said electrically conductive member.

2. A drone control system of claim 1 wherein said actuator members include readily connectable mechanical linkages adapted to being connected to at least some of said on-board engine and guidance controls, and an electrical motor device adapted to drive a said mechanical linkage.

3. A drone control system of claim 1 wherein said tension bearing member is pre-stretched and said light weight electrically conductive member is carried within said tension bearing member.

4. A drone control system of claim 1, wherein said flexible tow cable member is buoyant.

5. A drone control system of claim 1 including tow cable connection member adapted to be mounted on said watercraft and connected to said tension bearing member.

6. A drone control system of claim 1 wherein said drone control unit is adapted to occupy the area where an operator would normally ride on said watercraft.

7. A drone control system of claim 1 wherein said tow handle element comprises a central control panel including input control members adapted to supply control information to said microcontroller device.

8. The improved tow handle of claim 7 wherein said input control members comprise a start button which sends a signal to said microcontroller device to start the engine when said start button is depressed, a stop button which sends a signal to said microcontroller device to stop the engine when said stop button is depressed, an accelerator button which upon depression sends a signal to said microcontroller device to open the throttle, a decelerator button which upon depression sends a signal to said microcontroller device to close the throttle, a left button which upon depression sends a signal to said microcontroller device to steer the watercraft to the left, and a right button which upon depression sends a signal to said microcontroller device to steer the watercraft to the right.

9. The improved tow handle of claim 8 wherein said buttons are adapted to be manipulated by the thumbs of said water skier while maintaining his grasp of said handle.

10. A drone control unit for use in reversibly converting a small normally operator ridden watercraft of the type having on-board engine and guidance controls into a water skier controlled drone watercraft, said drone control unit adapted to being removably mounted to said watercraft to permit control of the operation of said watercraft from a remote location, said drone unit comprising:

a releasable mounting mechanism adapted to quickly and easily install and remove said drone control unit from said watercraft;

said drone control unit including a microcontroller device for monitoring and directing control information, actuator members in operative communication with said microcontroller device and adapted to being operatively connected to said on-board engine and guidance controls on said watercraft to activate such controls responsive to directions from said microcontroller device, said microcontroller device being adapted to receive electronic signals from a remote location and to actuate said on-board engine and guidance controls responsive to said electronic signals.

* * * * *